US006769134B1

(12) United States Patent
Mendez

(10) Patent No.: US 6,769,134 B1
(45) Date of Patent: Aug. 3, 2004

(54) SUPPORT ASSEMBLY FOR KNEELING

(76) Inventor: Francisco Mendez, 11321 NW. 4th St., Miami, FL (US) 33172

( * ) Notice: Subject to any disclaimer, the term of this patent is extended or adjusted under 35 U.S.C. 154(b) by 0 days.

(21) Appl. No.: 10/657,000

(22) Filed: Sep. 8, 2003

(51) Int. Cl.[7] ..... A41D 13/00
(52) U.S. Cl. ..... 2/22
(58) Field of Search ..... 2/22, 24, 455, 2/16, 911; 128/881, 882; 602/5, 26, 62, 19, 63

(56) References Cited

U.S. PATENT DOCUMENTS 1,136,307 A * 4/1915 Bourdon ..... 2/456
1,533,907 A 4/1925 Whipp
1,757,640 A * 5/1930 Levinson ..... 2/22
2,719,576 A 10/1955 Emmati
3,258,779 A 7/1956 Turner
4,180,261 A * 12/1979 Kolka ..... 482/105
3,025,528 A 3/1982 Ramon
4,373,709 A * 2/1983 Whitt ..... 5/650
4,433,679 A * 2/1984 Mauldin et al. ..... 602/16
4,599,748 A 7/1986 Garcia
4,772,071 A 9/1988 Richards
4,905,678 A * 3/1990 Cumins et al. ..... 602/16
6,039,677 A * 3/2000 Spletzer ..... 482/105
6,039,707 A * 3/2000 Crawford et al. ..... 602/5
6,637,034 B1 * 10/2003 Worden ..... 2/24

* cited by examiner

*Primary Examiner*—Tejash Patel

(57) ABSTRACT

A support assembly for kneeling includes a girdle for positioning around a waist of the person. Each of a pair of elongated supports has an upper end and a lower end. Each of a pair of feet is attached to one of the lower ends. Each of a pair of straps is attached to one of the supports for securing such to legs of the person. Each of a pair of brackets is attached to the girdle such that the brackets are positioned on opposite sides of the girdle. Each of the upper ends of the supports is pivotally coupled to one of the brackets. The girdle is positioned on the person such that the feet are positioned below and in front of each of a pair of knees of the person. The feet support the person's weight when the person is in a kneeling position.

7 Claims, 7 Drawing Sheets

SUPPORT ASSEMBLY FOR KNEELING

BACKGROUND OF THE INVENTION

1. Field of the Invention

The present invention relates to knee protection devices and more particularly pertains to a new knee protection device for supporting the weight of a person while the person is kneeling so that the knees of the person are not subjected to the weight.

2. Description of the Prior Art

The use of knee protection devices is known in the prior art. U.S. Pat. Nos. 4,599,748 and 3,025,526 illustrate the more common approach for the protection of knees while performing tasks which require kneeling. These devices generally are coverings that are placed on the knee to dissipate the amount of direct pressure that is placed on the knees. While helpful, these devices do not ultimately prevent knee injuries and only mediate the pain associated with doing such tasks.

For this reason the need remains for a device that completely removes the weight of the person from the person's knees to ensure that the knees are not subjected to the pressures incurred during kneeling. Also, such a device should re-direct the pressure to another portion of the body which can better sustain the weight.

SUMMARY OF THE INVENTION

The present invention meets the needs presented above by including supports which direct the weight of the user back to the waist so that the weight of the person is not being supported by the knees when the person kneels.

Another object of the present invention is to provide a new knee protection device that includes a leg receiving member for further adding in the comfort of the device by putting the weight on the waist and crotch area of the person.

To this end, the present invention generally comprises a girdle for selectively positioning around a waist of the person. Each of a pair of elongated supports has an upper end and a lower end. Each of a pair of feet is attached to one of the lower ends. Each of a pair of straps is attached to one of the supports for selectively securing each of the supports to one of a pair of legs of the person. Each of a pair of brackets is attached to the girdle such that the brackets are positioned on opposite sides of the girdle. Each of the upper ends of the supports is pivotally coupled to one of the brackets. The girdle is positioned on the person such that the feet are positioned below and in front of each of a pair of knees of the person. The feet support the person's weight when the person is in a kneeling position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
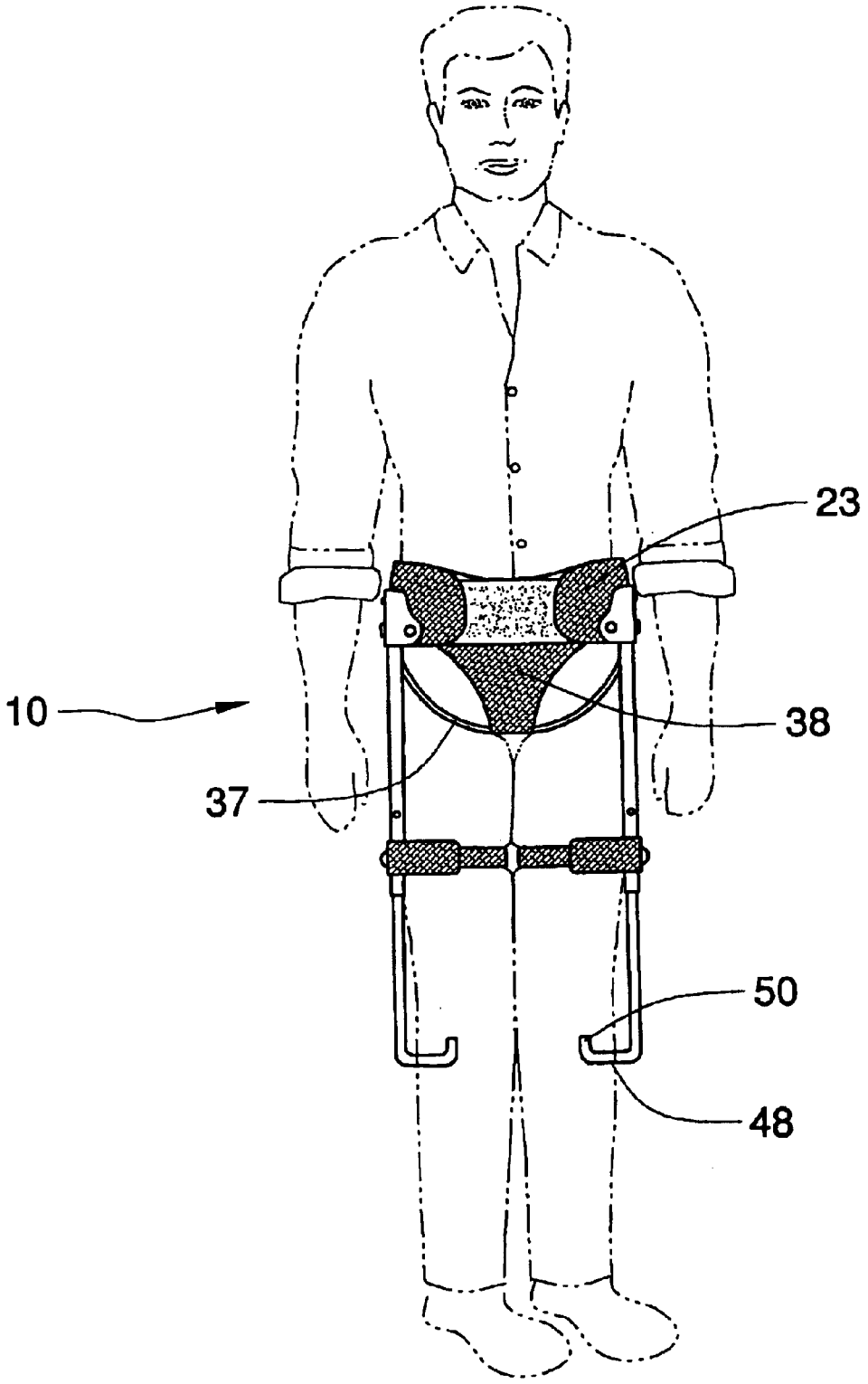
FIG. 1 is a schematic front view of a support assembly for kneeling according to the present invention.
Figure 2:
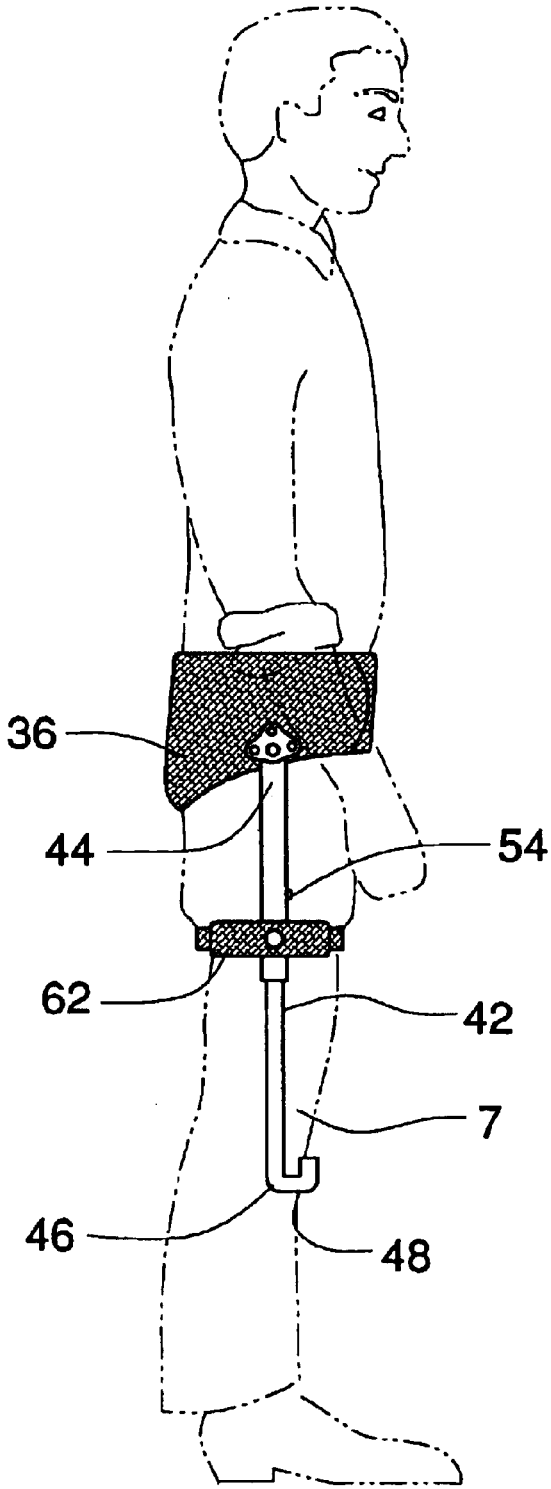
FIG. 2 is a schematic side view of the present invention.
Figure 3:
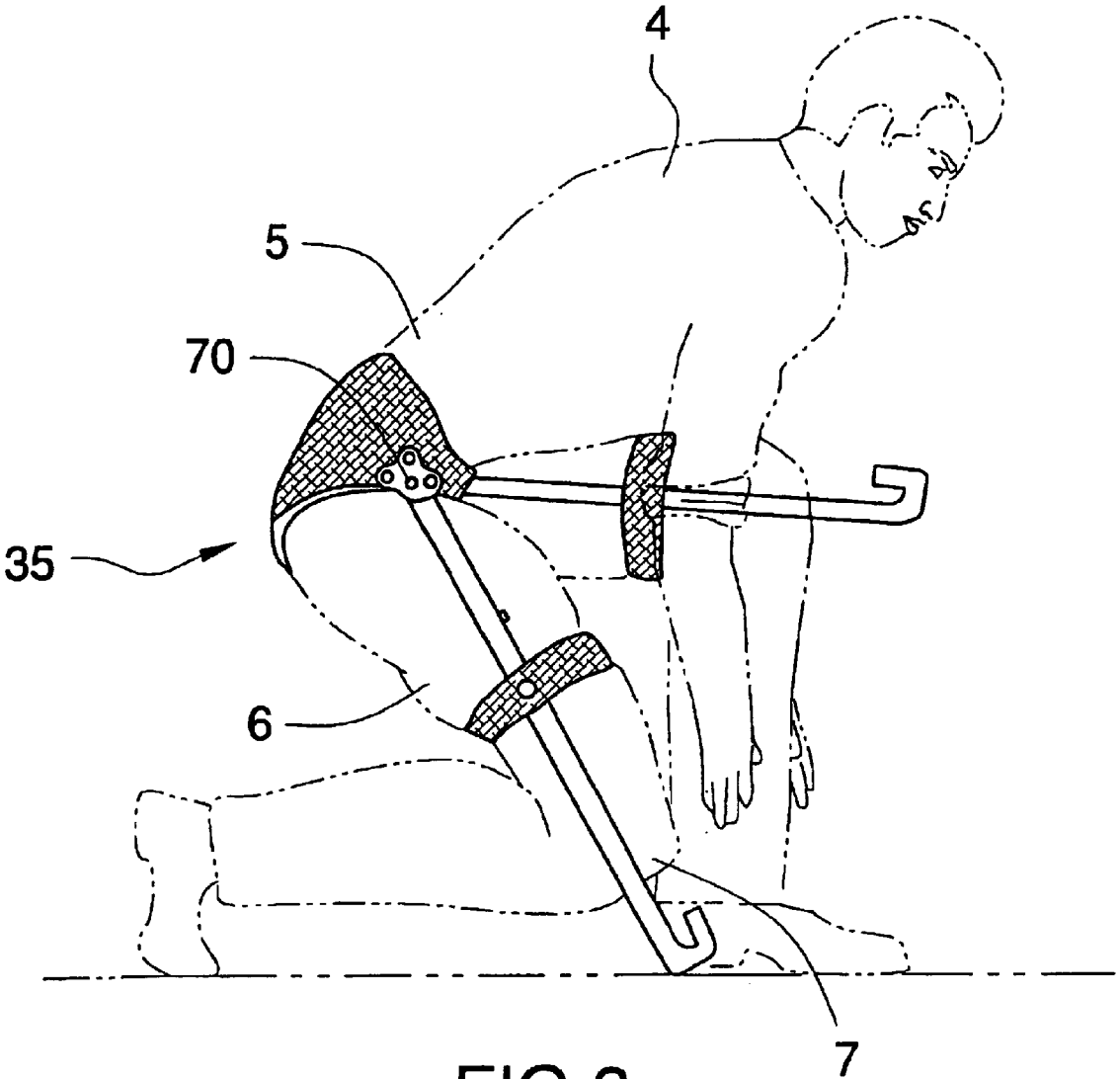
FIG. 3 is a schematic side in-use view of the present invention.
Figure 4:
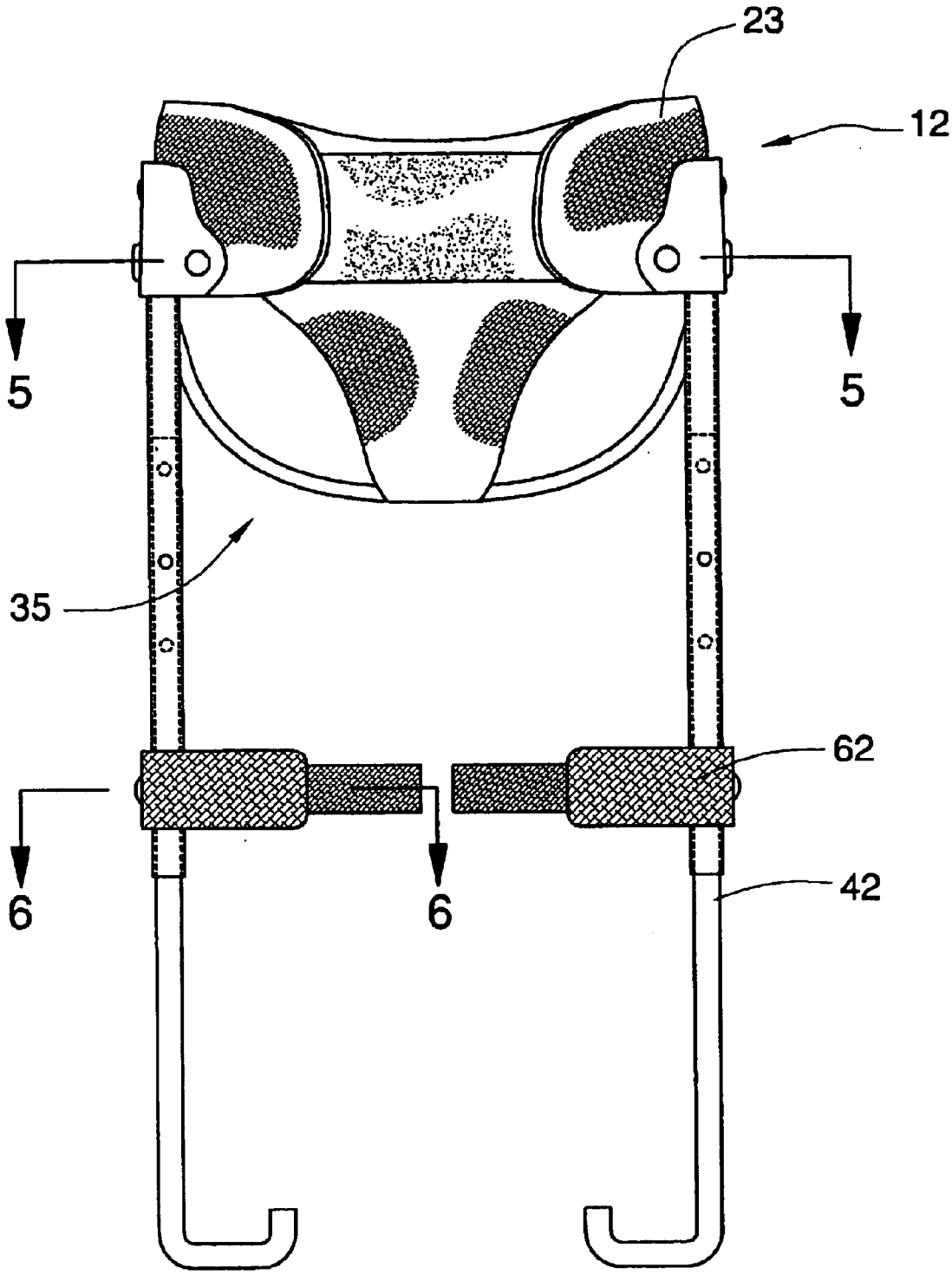
FIG. 4 is a schematic front view of the present invention.
Figure 5:
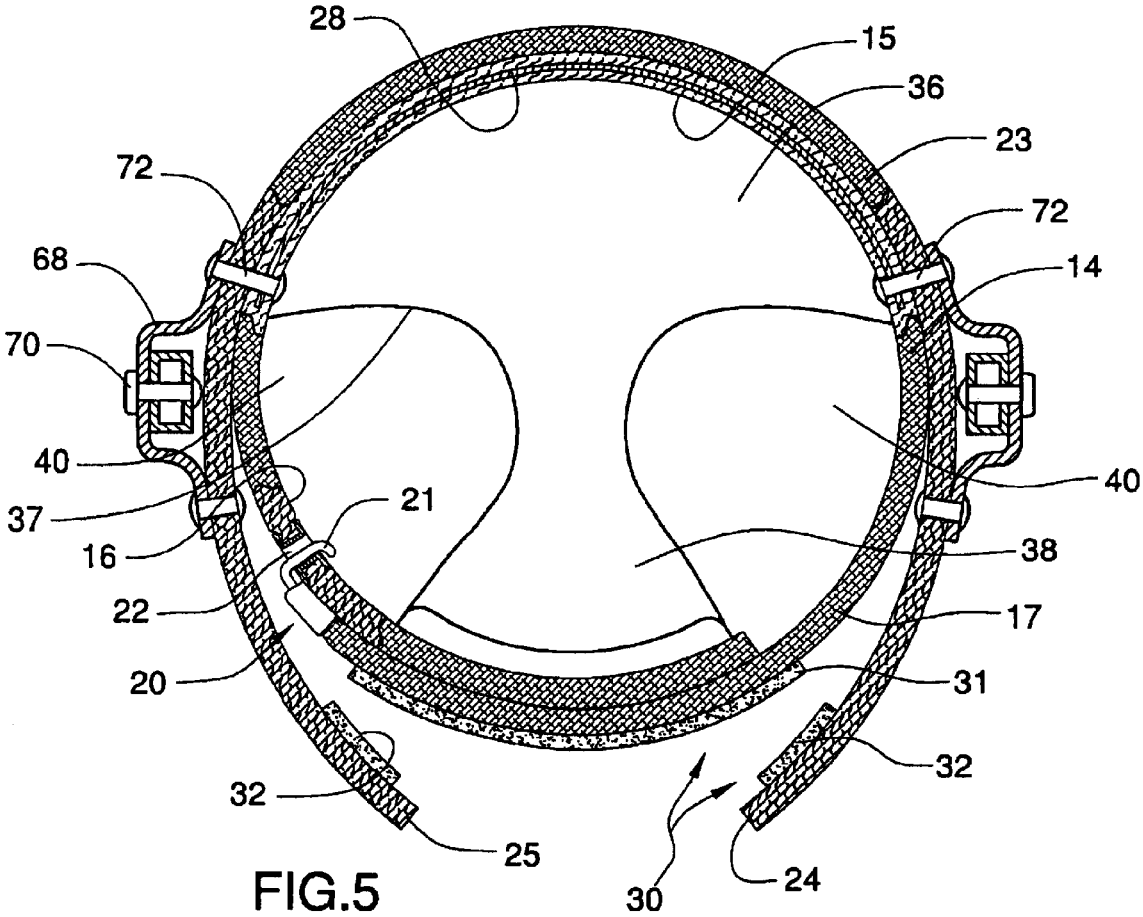
FIG. 5 is a schematic cross-sectional view taken along line 5—5 of FIG. 4 of the present invention.
Figure 6:
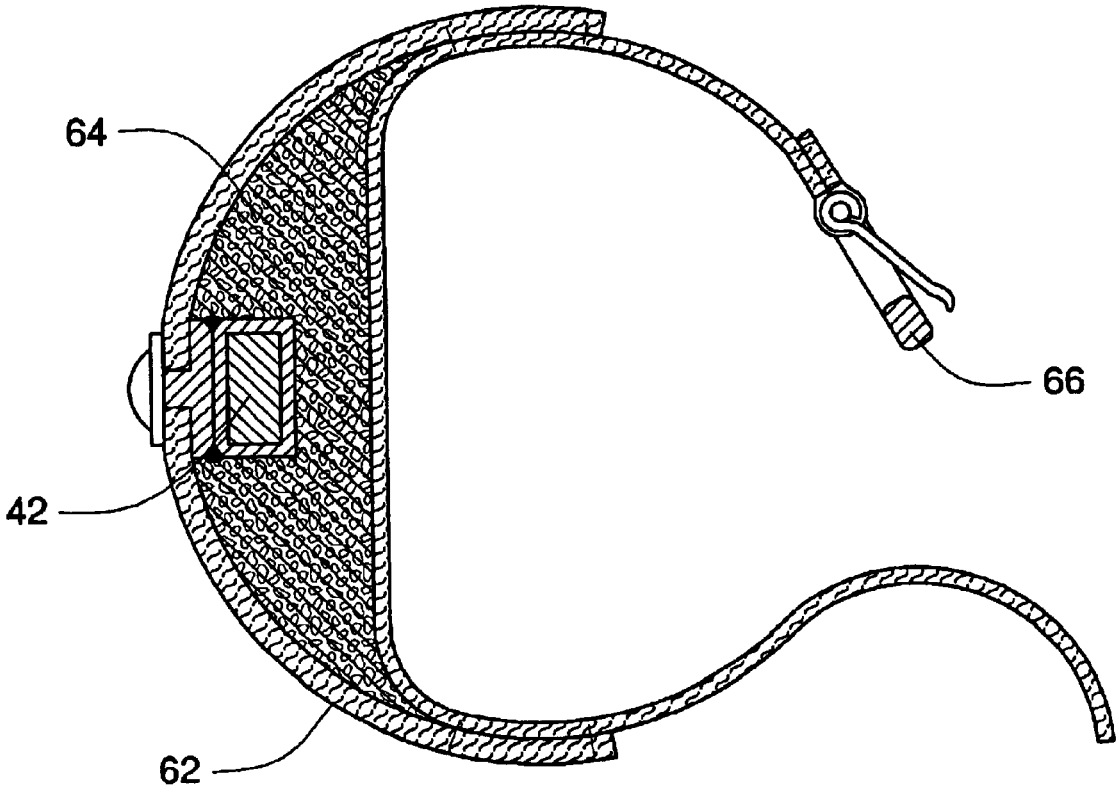
FIG. 6 is a schematic cross-sectional view taken along line 6—6 of FIG. 4 of the present invention.
Figure 7:
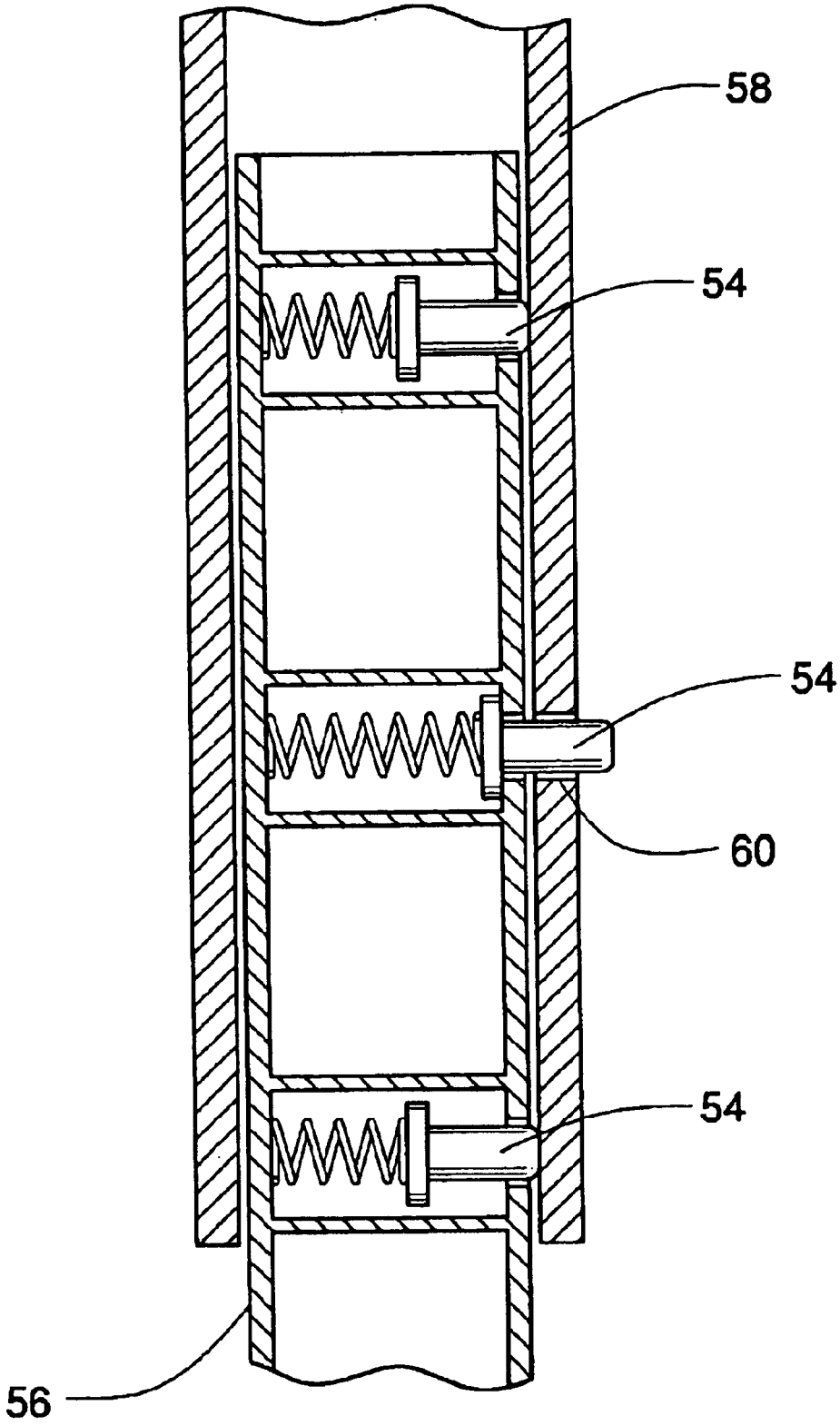
FIG. 7 is a schematic cross-sectional view of the support of a present invention.

With reference now to the drawings, and in particular to FIGS. 1 through 7 thereof, a new knee protection device embodying the principles and concepts of the present invention and generally designated by the reference numeral 10 will be described.

As best illustrated in FIGS. 1 through 7, the support assembly for kneeling 10 generally comprises a girdle 12 for selectively positioning around a waist 5 of a person 4. The girdle 12 includes an inner belt 14 member that is elongated and has central portion 15, a first end portion 16 and a second end portion 17. The inner belt member 14 generally forms a loop such that the first 16 and second 17 end portions overlap and an outer surface of the first end portion 16 is positioned adjacent to an inner surface of the second end portion 17. A securing member 20 is attached to the second end portion 17 for selectively securing second end portion 17 to the first end portion 16. The securing member 20 preferably includes a hook 21 that is removably extendable through an opening 22 in the first end portion 16. A metal plate 28 is positioned within the inner belt 14. The plate 28 is arcuate and generally extends along a length of the central portion 15. An outer belt 23 having a first end 24 and a second end 26 is attached to an outer surface of the central portion 15. The outer belt 23 may be attached to the inner belt 14 by stitching, an adhesive or a fastener as indicated below.

A coupling assembly 30 is attached to the outer belt 23 and the inner belt 14 for selectively attaching sections of the outer belt 23 adjacent to the first 24 and second 25 ends to the outer surface of the second end portion 17. The coupling assembly preferably includes a hook and loop coupling assembly including a first coupler portion 31 attached to the outer surface of the second end portion 17 and a second coupler portion 32 attached to the sections of the outer belt 23 adjacent to the first 24 and second ends 25.

The girdle 12 preferably includes a leg receiving member 35 that is attached to the outer 23 and inner 14 belts. The leg receiving member 35 includes a back wall 36 that is integrally coupled to the outer belt 23 and extends along a length of the central portion 15 of the inner belt 14. The back wall 36 extends downward and has an inner surface that has a concave shape such that forward edge 37 is defined. A front wall 38 is attached to and extends between an inner surface of the first end portion 16 and the forward edge 37. The front wall 38 has a pair of side edges 39. A space between the side edges 39 and the inner belt 14 defines leg receiving openings 40.

Each of a pair of elongated supports 42 has an upper end 44 and a lower end 46. Each of a pair of feet 48 is attached to one of the lower ends 46. The feet 48 may have any number of constructions though it is preferred that feet at least include a bar orientated perpendicular to a longitudinal axis of the supports. The bar should have an upturned end 50 to prevent its catching on a ground surface. Preferably, each of the supports 42 is selectively telescoping. A locking mechanism 52 locks the supports 42 at a selective length. The locking mechanism 52 preferably includes outwardly biased nubs 54 that are positioned in a first member 56 of the supports 42. The first member 56 is slidably extendable into a second member 58. The second member 58 includes an opening 60 for receiving the nubs 54 and locking the first 56 and second 58 members at a fixed length.

Each of a pair of straps 62 is attached to one of the supports 42 for selectively securing each of the supports 42 to one of a pair of legs 6 of the person 4. The straps 62 preferably include a padded section 64 through which the supports 42 extend. The straps 62 include buckles 66 for securing together free ends of the straps 62.

Each of a pair of brackets 68 is attached to the girdle 12 such that the brackets 68 are positioned on opposite sides of the girdle 12. A pivot member 70 pivotally couples each of the upper ends 44 of the supports 42 to one of the brackets 68. A pair of fasteners 72 preferably extends through one of the brackets 68 and into the metal plate 28. The fasteners 72 add support to the assembly 10 while also aiding in securing the inner belt 14 to the outer belt 23.

In use, the girdle 12 is positioned on the person 4 such each of the legs 6 extends through one of the leg openings 40 and the feet 48 of the supports 42 are positioned below and in front of each of a pair of knees 7 of the person 6. When the person 4 kneels, the feet 48 come forward and are positioned on the ground surface to support the weight of the person 4 so that no weight is placed on the knees 7.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support assembly for supporting the weight of a person in a kneeling position, said assembly including:

a girdle for selectively positioning around a waist of the person;

a pair of elongated supports, each of said supports having an upper end and a lower end, each of a pair of feet being attached to one of said lower ends;

a pair of straps, each of said straps being attached to one of said supports for selectively securing each of said supports to one of a pair of legs of the person; and a pair of brackets, each of said brackets being attached to said girdle such that said brackets are positioned on opposite sides of said girdle, each of said upper ends of said supports being pivotally coupled to one of said brackets; and wherein said girdle is positioned on the person such that the feet are positioned below and in front of each of a pair of knees of the person.

2. The support assembly of claim 1, wherein said girdle includes:

an inner belt member being elongated and having central portion, a first end portion and a second end portion, said inner belt member generally forming a loop such that said first and second end portions overlap and an outer surface of said first end portion is adjacent to an inner surface of said second end portion;

a metal plate being positioned within said inner belt, said plate being arcuate and generally extending along a length of said central portion;

an outer belt being attached to an outer surface of said central portion, said outer belt having a first end and a second end; and a coupling assembly being attached to said outer belt and said inner belt for selectively attaching sections of said outer belt adjacent to said first and second ends to said outer surface of said second end portion.

3. The support assembly of claim 2, wherein said girdle further includes a leg receiving member being attached to said outer and inner belts, said leg receiving member including a back wall being integrally coupled to said outer belt and extending along a length of said central portion of said inner belt, said back wall extending downward and having an inner surface having a concave shape such that forward edge is defined, a front wall being attached to and extending between an inner surface of said first end portion and said forward edge, said front wall having a pair of side edges, wherein a space between said side edges and said inner belt defines leg receiving openings.

4. The support assembly of claim 1, wherein each of said supports is selectively telescoping.

5. The support assembly of claim 2, further including each of a pair of fasteners extending through one of said brackets and into said metal plate.

6. The support assembly of claim 1, wherein said girdle further includes a leg receiving member being attached thereto for selectively receiving legs of the person.

7. A support assembly for supporting the weight of a person in a kneeling position, said assembly including:

a girdle for selectively positioning around a waist of the person, said girdle including;

an inner belt member being elongated and having central portion, a first end portion and a second end portion, said inner belt member generally forming a loop such that said first and second end portions overlap and an outer surface of said first end portion is adjacent to an inner surface of said second end portion;

a securing member being attached to said second end portion for selectively securing second end portion to said first end portion;

a metal plate being positioned within said inner belt, said plate being arcuate and generally extending along a length of said central portion;

an outer belt being attached to an outer surface of said central portion, said outer belt having a first end and a second end;

a coupling assembly being attached to said outer belt and said inner belt for selectively attaching sections of said outer belt adjacent to said first and second ends to said outer surface of said second end portion, said coupling assembly including a hook and loop coupling assembly including a first coupler portion attached to said outer surface of said second end portion and a second coupler portion attached to said sections;

a leg receiving member being attached to said outer and inner belts, said leg receiving member including a back wall being integrally coupled to said outer belt and extending along a length of said central portion of said inner belt, said back wall extending downward and having an inner surface having a concave shape such that forward edge is defined, a front wall being attached to and extending between an inner surface of said first end portion and said forward edge, said front wall having a pair of side edges, wherein a space between said side edges and said inner belt defines leg receiving openings;

a pair of elongated supports, each of said supports having an upper end and a lower end, each of a pair of feet being attached to one of said lower ends, each of said supports being selectively telescoping;

a pair of straps, each of said straps being attached to one of said supports for selectively securing each of said supports to one of a pair of legs of the person; and a pair of brackets, each of said brackets being attached to said girdle such that said brackets are positioned on opposite sides of said girdle, each of said upper ends of said supports being pivotally coupled to one of said brackets, each of a pair of fasteners extending through one of said brackets and into said metal plate; and wherein said girdle is positioned on the person such that the feet are positioned below and in front of each of a pair of knees of the person.

* * * * *